US006906983B2

(12) United States Patent
Williams et al.

(10) Patent No.: US 6,906,983 B2
(45) Date of Patent: Jun. 14, 2005

(54) AUTONOMOUS EAR-PLUG ALARM WITH SEPARATE SETTING DEVICE

(76) Inventors: Joanna Margaret Williams, 11265 E. Chuckwagon Cir., Tucson, AZ (US) 85749; Darin Scot Williams, 11265 E. Chuckwagon Cir., Tucson, AZ (US) 85749

( * ) Notice: Subject to any disclaimer, the term of this patent is extended or adjusted under 35 U.S.C. 154(b) by 381 days.

(21) Appl. No.: 10/004,964

(22) Filed: Dec. 4, 2001

(65) Prior Publication Data

US 2002/0122354 A1 Sep. 5, 2002

Related U.S. Application Data

(60) Provisional application No. 60/251,372, filed on Dec. 5, 2000.

(51) Int. Cl.[7] ..... G04B 47/00
(52) U.S. Cl. ..... 368/10; 368/12
(58) Field of Search ..... 368/10, 12, 47, 368/49, 51, 52, 60

(56) References Cited

U.S. PATENT DOCUMENTS

| | | | | | |
|---|---|---|---|---|---|
| 4,777,474 | A | * | 10/1988 | Clayton | 340/539.11 |
| 4,821,247 | A | * | 4/1989 | Grooms | 368/63 |
| 5,511,046 | A | * | 4/1996 | Vanderpal | 368/63 |
| 5,686,882 | A | * | 11/1997 | Giani | 340/407.1 |
| 5,894,455 | A | * | 4/1999 | Sikes | 368/12 |
| 6,067,006 | A | * | 5/2000 | O'Brien | 340/384.1 |

* cited by examiner

*Primary Examiner*—Vit Miska
*Assistant Examiner*—Thanh S. Phan

(57) ABSTRACT

An ear-plug alarm comprises a base station which sets the time, and ear-piece which provides autonomous timing and alarm functions after it is disconnected from the base station. The base station is implemented in personal computer software with an appropriate interface. Each ear-piece stores its own alarm setting, and operates autonomously after it is disconnected, so that a single base station can support any number of ear-pieces. With this method the alarm becomes a count down from the time that it is set, relieving the ear-piece timer of any long-term accuracy requirement.

11 Claims, 8 Drawing Sheets

```
:020000020000FC
:1000000004C018951895FFC08100E8E0FF27C89547
:1000100001BE002742D1592E442702E009BF00E863
:1000200008B90DE107BB0FEF08BB789404B702FFD6
:1000300003C00B7F04BF88C02FD190FD8FC00AC0C2
:10004000C4982AD19E7F1FD100E305BF00E40BBFF7
:10005000000000C000270BBF05BF01E003BF0ED1A9
:1000600088E082BF00C025E066D156F364D146F334
:10007000EF28C9F70D2D0A31B0F7442019F0AD185B
:10008000BE08CF082A9591F74ED14DD108E0A01AAD
:1000900000E0B00AC00A71E0A9E408940B2D0C2915
:1000A000A0FD39F0A795F9F20027701F3CD1889484
:1000B000F5CF713019F40A2D0034A8F21EF47395AF
:1000C00009F47A958A2D819573BF82BFF894D3D0B5
:1000D0005EEC7894112019F4B199FCCFF5CFB99A60
:1000E000BD9A93E508D1D8D006D10395D6D003D1D7
:1000F000972F01D1982FFFD095E4FDD0B998BD98E6
:10010000F894B9D051E07894E7E0CFD02EF1908305
:10011000E395EE30D1F708E07016B1F203E5701602
:10012000B9F405E4D016A1F4052DE8E0B0819B2FC9
:10013000AAD0B3D09B1749F40395E395ED30B1F7FE
:10014000ABD09170B9F486CF82D081D080D07FD0EF
:100150007ED07DD07CD07ECFC8F3F9CF78D077D059
:10016000052D0E5F9AD0A92E039597D0B92E039531
:1001700094D0C92EF89400E205BF00E40BBF05E05F
:1001800003BF882702BF7AD05A2D6B2DAA27B199B9
:10019000A3957894C3E0BFEFC49888950027B199E0
:1001A00003950A1729F0B51719F0B52FCA9529F04C
:1001B000112099F363D0C39481F7002705BFCC23A6
:1001C00011F40BBFC7CF68D09E7F5DD0BB27B1991C
:1001D000B395F89402E003BFA3E086E0F894C9E089
:1001E000F89449D04EEF78940027B19903950B17F6
:1001F00049F41120C9F3CA9599F78F5F78F3AA954E
:1002000061F71ECF27CF6FB682BF442399F0DAF48F
:100210004F3F49F0C49902C0C49A01C0C498581B0A
:1002200080F0089409C0112311F0C19A02C00000A7
:10023000C1984427539529F4639519F45095609516
:10024000162E6FBE18951127B1991395F2CFF89419
:1002500015D068EF03E003BF4EEF80EF82BF7894C4
:100260001120F1F3F8940AD068EF4EEF88EF7894FC
:100270001120F1F3089555276FEF01C06627552728
:10028000442711240895E199FECF0EBB9DBBF8943D
:10029000E29AE19A78940895052DE199FECF0EBB7C
:1002A000E09A000000009DB30895992738E0082FD8
:1002B00001950695713009F40B5001950894B19B96
:1002C00017C01120A1F4B199FCCF02BF02BF02BF39
:1002D00041E04423F1F741E04423F1F71795979566
:1002E0003A95C9F7E894B19904C01120E1F38894D4
:1002F000689451E00895F8944FEF112778944423BF
:10030000F1F738E010E090FB10F94FEF4423F1F7DC
:1003100096953A95B9F731E011E04FEF4423F1F7A4
:100320003A95D1F708958894C794B794A794E89420
:100330000EF468940895DA2CEB2CFC2C112089F42F
:10034000B19BFCCF112069F4B199FCCFF89472B63F
:10035000852E962E7894772031F4839421F493940B
:1003600011F4689408951120E1F7B19BFCCFF89443
:10037000A2B6B52EC62E7894AA2021F4B39411F417
:10038000C39479F3A718B808C90878F04424DA1898
:10039000EB08FC0874F44394D094E094F094D39464
:1003A00041F4E39431F4F39422F40FEFA02EB02E35
:0603B000C02EE894089540
:00000001FF
```

Intel HEX format

FIG.8A

```
:020000020000FC
:1000000004C01895BCC0B0C018954FEF00E20BBFFC
:1000100001E003BF02E009BF00E808B901E007BB47
:100020000FEF08BB789401E003BF88E082BFC0D027
:100030002227B2992395C3D06FEA0027B29903957E
:100040002017B1F71120C9F33327B599339500274D
:10005000B2990395201761F70027B59903953017DA
:10006000B1F3A2D001E003BF88E082BFA8D015E0C1
:10007000B2D0C6F3B0D0B6F3EF28A1F70D2D0531FD
:1000800088F7442019F0AD18BE08CF081A9591F7EB
:100090009AD099D008E0A01A00E0B00AC00A71E036
:1000A000A9E408940B2D0C29A0FD39F0A795D1F2F5
:1000B0000027701F88D08894F5CF713019F40A2D6D
:1000C000003480F21EF4739509F47A958A2D819597
:1000D00073BF82BF71D058ED3327B5993395002790
:1000E000B59903950317B1F71120C9F361D0B59BFA
:1000F00022C008C05DD00027B59903950130C9F42E
:100100001120C9F359D053E80027B5990395013060
:1001100071F41120C9F348D052D03327B5993395E3
:100120003323D9F71120B1F270CFB4E005C0B3E0AA
:1001300003C0B2E001C0B1E04FEFF89405E003BFA7
:10014000882782BF8BBF7894F89436D05EEF78947E
:100150001120F1F3BA9539F0F8942ED05FEF78942E
:100160001120F1F3F1CF51CF6FB682BF539529F42F
:10017000639519F450956095162E6FBE18956FB65D
:10018000442359F042F0B59904C00000C298BA9ACD
:1001900002C0C29ABA986FBE1895B29903C0000007
:1001A000C098F9CFC09AF7CFF89441E0BA9AE7CF58
:1001B000F8944427BA98E3CF55276FEF01C066271C
:1001C000552711240895889 4C794B794A794E89468
:1001D0000EF468940895DA2CEB2CFC2C112089F491
:1001E000B59BFCCF112069F4B599FCCFF89472B699
:1001F000852E962E7894772031F4839421F493946D
:1002000011F4689408951120E1F7B59BFCCFF894A0
:10021000A2B6B52EC62E7894AA2021F4B39411F478
:10022000C39479F3A718B808C90878F04424DA18F9
:10023000EB08FC0874F44394D094E094F094D394C5
:1002400041F4E39431F4F39422F40FEFA02EB02E96
:06025000C02EE8940895A1
:00000001FF
```

Intel HEX format

FIG.8B

AUTONOMOUS EAR-PLUG ALARM WITH SEPARATE SETTING DEVICE

CROSS-REFERENCE TO RELATED APPLICATIONS

This application claims the benefit of provisional patent application No. 60/251,372 filed Dec. 5, 2000.

STATEMENT REGARDING FEDERALLY FUNDED R&D

No federal R&D funds were used in the development of this invention.

REFERENCE TO LIST OR CD APPENDIX

Not applicable.

BACKGROUND OF THE INVENTION

1. Field of Invention

This invention relates to timing devices, specifically to alarm clocks.

2. Description of Prior Art

The need for help to awaken from sleep is so prevalent as to have spawned a vast variety of solutions over the centuries. When people share a room the problem becomes even more complex: sleepers often wish to wake without waking their roommates (to avoid the consequent wrath). If the sleeper happens to be particularly hard of hearing, he risks not awakening at all, or waking others in nearby rooms. We wish to reliably awaken one sleeper without disturbing others.

Existing solutions range from the nearly adequate to the silly. They include pillow vibrators, vibrating wrist bands, audio alarms placed in or under the user's pillow, and even alarms that sit in the user's ear. But, all existing solutions have significant limitations.

U.S. Pat. No. 5,072,429 to Mair (1991) tries to deal with the problem by placing the alarm sound closer to the sleeper, so that it doesn't have to be loud enough to wake anyone else. Specifically, Mair places the alarm within a special pillow. Another common solution is a small speaker placed under the pillow, attached to the earphone jack of a conventional clock-radio. But such arrangements are relatively useless for waking a heavy sleeper without waking light sleepers in the same room. Light sleepers are often far more sensitive to sounds, so that a small difference in proximity is not enough to shield them. Even without this limitation, a restless sleeper is likely to remain asleep after moving off their pillow or shoving the device aside. U.S. Pat. No. 2,517,368 to Wiseley (1950) carries this idea to the limit by using a hearing-aid speaker. But in both concepts there is a significant safety hazard. Both require wires in which the sleeper can become entangled during sleep.

Pager type watches, such as U.S. Pat. No. 5,297,118 to Sakumoto (1994), could be used for a similar function. But again, there is the problem of making it loud enough to reliably wake the sleeper without waking anyone else. Particularly if the sleeper's arm wanders under the covers, this is a serious limitation. Anything loud enough to wake the sleeper in this circumstance will certainly wake their roommates when the alarm is above the covers. Also, this approach is still dependent upon an external timing source.

U.S. Pat. No. 4,093,944 to Muncheryan (1978) and U.S. Pat. No. 5,144,600 to Cheng (1992) avoid the sound volume problem by placing vibrating devices under the sleeper's pillow. Of necessity, the devices are relative large and inconvenient. U.S. Pat. No. 4,920,525 to Meister (1990) expands this idea to a more general purpose timer and battery-powered vibrator, but with similar limitations. Vibrating devices that are not physically attached to the sleeper are relatively useless for the restless: they are too easily pushed aside during sleep.

U.S. Pat. No. 5,764,594 to Berman (1998) and U.S. Pat. No. 5,686,882 to Giani (1997) overcome this difficulty by using a vibrating wrist band. The vibration is triggered by a signal from a separate base station which actually does the timing. The operation of the wrist band is completely dependent upon the base station. It cannot be separate from it by more than a short distance (based on the signal range). A power failure in the base station prevents the alarm from operating, and lets the user over-sleep. This tightly-coupled configuration requires additional complexity in the base station to support additional independent wrist bands, hence Berman's stated intent to wake the second sleeper via the audio alarm. It also requires the wrist-band electronics to be active all the time, listening for an alarm signal, driving battery consumption.

The same basic problem plagues U.S. Pat. No. 5,894,455 to Sikes (1999). Here, the wristband is replaced with an ear-piece, and vibration with an audible alarm. Since the sound is emitted directly into the ear, it can easily be loud enough to wake the sleeper without waking anyone else. But, this approach has the same flaws as Berman's, in that it is totally reliant upon the base station. Also, the electronics must continually listen for an alarm signal, wasting battery power.

U.S. Pat. No. 4,456,387 to Igarashi (1984) avoids these problems by using an autonomous vibrating watch. However, those of us who have nearly jumped out of our skins when a vibrating pager "went off" would not consider this a pleasant way to awake. A rude awaking can degrade both attitude and productivity for the entire day.

U.S. Pat. No. 4,821,247 to Grooms (1989) bypasses virtually all of these problems with an in-ear alarm clock. But, this approach creates new problems. Since the device is entirely self-contained, it has buttons and a display for setting the time and alarm functions. This simultaneously makes the controls too small for convenient use, and makes the ear-piece far too large for comfortable wear during sleep. It is large enough to be quite uncomfortable, and to be easily brushed from the ear during sleep. Older users, in particular, would still have to find their reading glasses to set the alarm.

BRIEF SUMMARY OF THE INVENTION

In accordance with the present invention, an ear-plug alarm comprises a base station, a separate device or personal computer software with interface, which sets the time, and any number of ear-pieces which provide autonomous timing and alarm functions after they are disconnected from the base station.

Objects and Advantages

The present invention overcomes deficiencies in the prior as follows:

(a) An alarm which rests securely in the sleeper's ear will not be pushed aside during sleep, and the sleeper cannot roll away from it, like an alarm pillow, so that the sleeper will be awakened reliably.

(b) An audio alarm wakes the sleeper to a comfortable and familiar sensation, unlike vibrators. Indeed, the goal is to reliably awaken the sleeper while "alarming" her as little as possible.

(c) A pleasant chirp sound with a low repetition rate (about 1 Hz) provides a reliable but mild awakening. The changing tone is more effective than a static tone, and the chirp crosses a wide range of frequencies, mitigating the impact of any partial hearing loss.

(d) Generating the alarm in a programmable processor allows considerable flexibility in controlling volume, tone, or in producing specific sounds. This functionality is well established in the prior art, and could easily be added to the current embodiment.

(e) Placing the alarm directly in the ear provides substantial volume levels to the sleeper, which are, nonetheless, imperceptible only a few feet away. Releasing the sound directly into the ear canal, as opposed to near the ear in an earring configuration, magnifies this effect, and further damps any escaping sound.

(f) The in-ear configuration also damps outside noise, providing an additional aid to sleep, without the liability of masking sounds from an external alarm clock. This solves the traditional dilemma of wanting to wear ear plugs for a noisy environment when you still need to get up in the morning.

(g) Making the ear-piece entirely autonomous after it is set removes any wires, preventing the ear-piece from being pulled out during sleep and removing the attendant safety hazard. It also removes the conductive path to the sleeper's ear, which is quite beneficial in areas prone to lightning strikes.

(h) Using a separate base station to set the alarm allows the ear-piece to be remarkably small. It does not need the additional size for buttons or a display. With production electronics it could easily be manufactured to sit entirely within the ear canal, essentially immune to being dislodged during sleep. Even the current embodiment for low-quantity production using commercially available components, is far smaller than previous inventions that required the ear-piece to be fully autonomous.

(i) Setting the ear-piece from the base station greatly relieves accuracy requirements for the ear-piece timing system. The ear-piece is not required to maintain an accurate time-of-day over months, only to count the time until alarm for a single sleep. This allows the current embodiment for low-quantity production to be built without adding a timing crystal, while still maintaining accuracy to a few minutes.

(j) Use of commercially available gel ear adapters allows a simple ear-piece built from commercially available parts to rest comfortably and to remain reliably in the ear. Different adapters handle different sized and shaped ears.

(k) Non-volatile time storage in the ear-piece and autonomous operation after disconnect allows a single base-station to support an arbitrary number of ear-pieces. Each ear-piece remembers its previous setting, so that it can simply be turned on for the next day.

(l) Autonomous operation after disconnect makes the alarm immune to house power failures.

BRIEF DESCRIPTION OF DRAWINGS

In the drawings, closely related figures have the same number but different alphabetic suffixes. The same guideline is followed for reference numerals.

FIG. 8A shows the object code for the current embodiment of the ear-piece, using an Atmel ATTiny12 micro-controller.

FIG. 8B shows the object code for the micro-controller in the current embodiment of the personal computer interface.

REFERENCE NUMERALS IN DRAWINGS

| | |
|---|---|
| 10 | ear-piece |
| 11 | ear-piece connector |
| 15 | gel ear-piece adapter |
| 16 | interface adapter |
| 17 | base station connector |
| 18 | personal computer |
| 19 | base station |
| 20 | ear-piece interface |
| 21 | disconnect and power |
| 22 | signal separation |
| 23 | ear-piece battery |
| 24 | controller |
| 25 | timer |
| 26 | non-volatile storage |
| 27 | sounder |
| 30 | micro-jack |
| 31 | stereo micro-plug |
| 33 | RS-232 level converter |
| 34 | interface processor |
| 35 | ear-piece processor |
| 36 | ear-piece isolation capacitor |
| 37 | interface isolation capacitor |
| 39 | RS-232 data lines in/out |
| 41 | repeat test |

-continued

| | |
|---|---|
| 42A | transmit wait |
| 42B | second transmit wait |
| 43 | send sync |
| 44 | receive setting |
| 45 | setting available test |
| 46 | setting match test |
| 47 | calculate delay |
| 48 | send new setting |
| 51 | base station transmit interval |
| 52 | transmit idle interval |
| 53 | receive interval |
| 54 | base station transmit OK interval |
| 55 | ear-piece transmit interval |
| 56 | ear-piece transmit wait delay |
| 57 | ear-piece setting wait delay |
| 58 | minimum transmit idle delay |
| 59 | base station transmit delay |
| 60 | sync signal wave form |
| 61 | bit-time reference marks |
| 65a | first low pulse |
| 65b | second low pulse |
| 66 | transmit line idle |
| 67 | start bit |
| 68 | data bits |
| 69 | stop bit |
| 71 | start message flag |
| 72 | setting least-significant byte |
| 73 | setting most-significant byte |
| 74 | ear-piece data byte-1 |
| 75 | ear-piece data byte-2 |
| 76 | end message flag |
| 77 | delay byte-1 |
| 78 | delay byte-2 |
| 79 | delay byte-3 |
| 90A | battery − contact |
| 90B | battery + contact |
| 91 | connection to case |
| 92 | conductive epoxy bond |
| 93 | sounder connection |
| 94 | contact to chip Vcc |
| 95A | insulating layer |
| 95B | second insulating layer |
| 96A | wire routing hole |
| 96B | wires to connector |
| 97 | cored-out piezo microphone |
| 98 | plastic cap |
| 99 | gap |

DETAILED DESCRIPTION

Overview (FIG. 1)

Figure 1A:
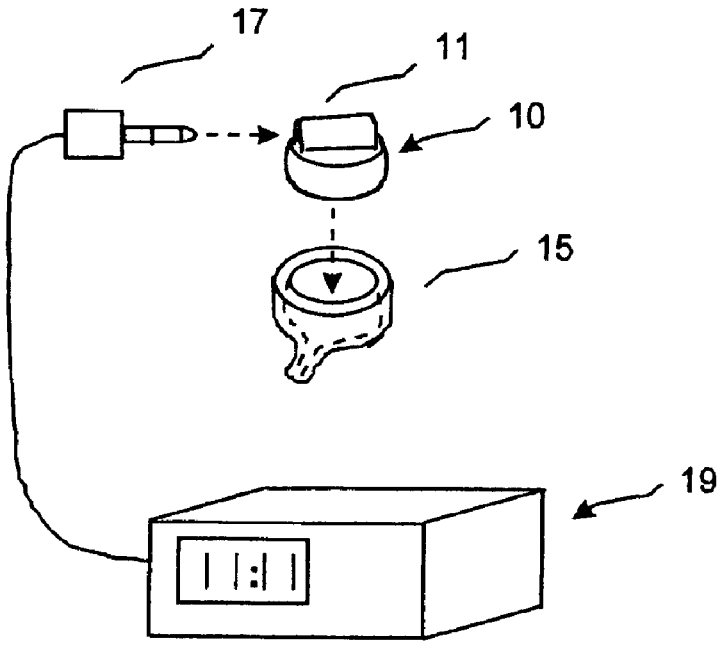
FIGS. 1A and 1B show the separate components of the ear-plug alarm. In 1B the base station is implemented using a personal computer and interface, as in the current reduction to practice.
Figure 1B:
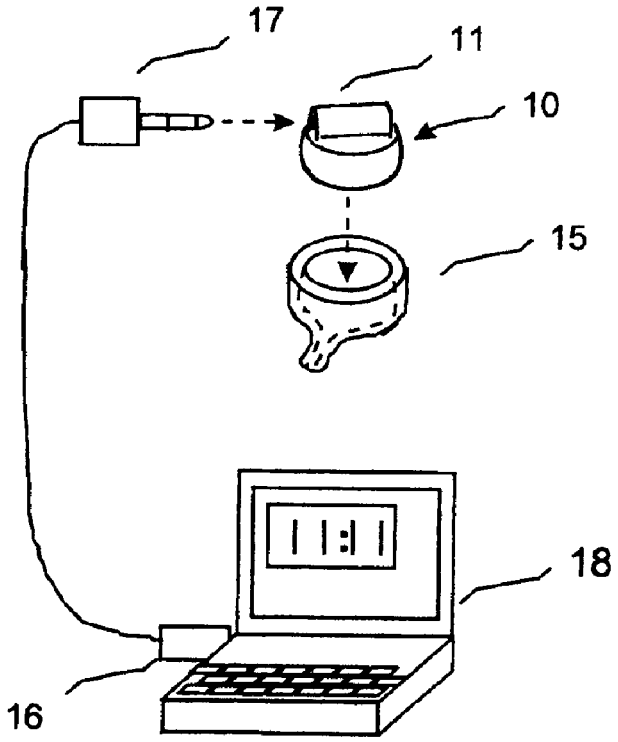

The preferred embodiment of the ear plug alarm is presented in FIG. 1A. An ear-piece 10 connects to a base station 19 for setting the alarm, then operates autonomously when disconnected. In FIG. 1B the base station 19 is implemented using software on a personal computer 18 with an interface adapter 16 to adapt RS-232 serial signals to the ear-piece 10. The ear-plug alarm would be available in both configurations. A base station connector 17 is place into an ear-piece connector 11 to set the time, then removed afterward.

Rather than requiring that the ear-piece 10 be manufactured in a shape to fit the ear, it is placed in a commercially available gel ear-piece adapter 15. These are available in different sizes, keeping the ear-piece 10 in place comfortably and reliably for sleeper with different ear sizes and shapes.

While the ear-piece 10 is connected to the base station 19 it is powered from the base station 19. When disconnected it is powered by internal batteries, and operates autonomously.

Figure 2:
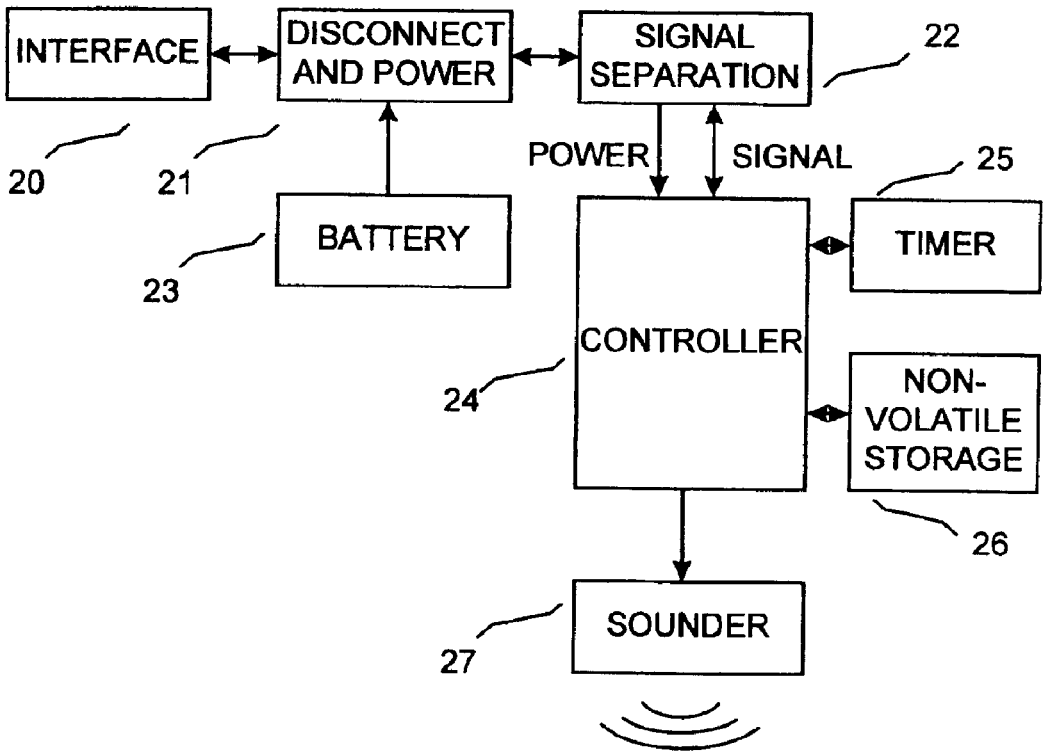
FIG. 2 shows the function blocks of the ear-piece.

Ear-piece Functional Elements (FIG. 2)

The functional elements of the ear-piece 10 are depicted in FIG. 2. An ear-piece interface 20 supports connection of power and signal from the ear-piece 10 to the base station 19. A disconnect and power 21 circuit allows the ear-piece 10 to be powered from the base station 19 while attached to it, and from a ear-piece battery 23 when disconnected. A signal separation 22 separates the setting signals from the power to the rest of the ear-piece 10. A controller 24 handles all interface and control functions of the ear-piece 10. It retrieves previous setting from a non-volatile storage 26 and reports them to the base station 19. It receives settings from the base station 19, stores them in the non-volatile storage 26, and if the setting is "on", configures a timer 25 to implement the appropriate delay. After this delay has expired, an alarm tone is produced via a sounder 27.

Data Transmission Protocols (FIGS. 5, 6, 7A, 7B)

Figure 5:
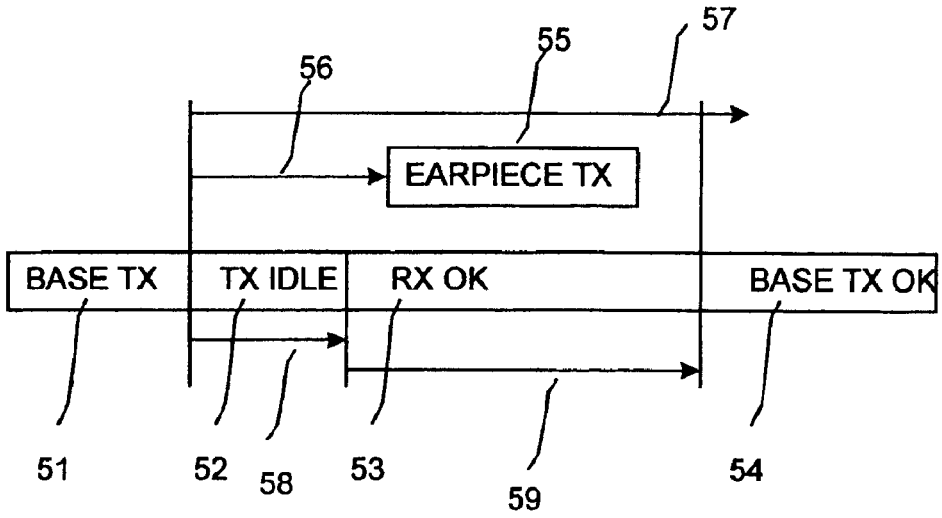
FIG. 5 shows the time multiplexed protocol used for bi-directional communication between the ear-piece and the base station over a single wire.

To minimize connectors, receive and transmit for the ear-piece 10 is done on a single wire, using a half-duplex protocol described in FIG. 5. The base station 19 is the master, and controls all communications to avoid collisions. We always start in a base station transmit interval 51.

Figure 6:
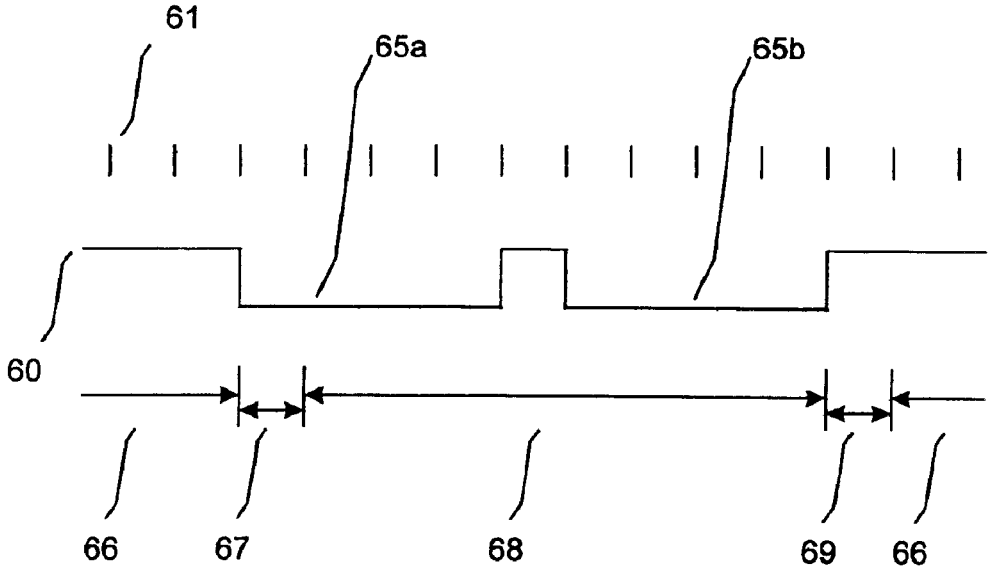
FIG. 6 shows the time wave form for the RS-232 sync character used in this communications protocol, an ASCII control-H.

The first signal from the base station 19 is always a series of sync characters. As depicted in FIG. 6, the sync character is an ASCII control-H, producing the sync signal wave form 60. This is convenient for identifying bit timing because all negative-going pulses, first low pulse 65A and second low pulse 65B, are exactly 4 bits long, referencing to a bit-time reference marks 61. As usual, RS-232 characters are sent least-significant bit first with one start bit 67 and one (or more) stop bit 69, and with transmit line idle 66 in between. Note that the first low pulse 65A actually extends beyond the data bits 68, including the start bit 67. The base station 19 sends ⅓ second of sync characters, 400 characters at the current rate of 1200 baud. The bit time is measured as ¼ the duration of the low going pulses, and subsequent time outs are in bit times, simplifying the personal computer 18 interface. This also determines this bit time for returned messages. This approach makes it unnecessary for the ear-piece processor 35 or interface processor 34 in FIG. 3 to know the personal computer 18 bit timing a-priori. The string of sync characters also allows the ear-piece processor 35 to identify the start of a new transmission.

The relatively long period of sync characters provides the ear-piece 10 time to awaken from low-power modes. While it is counting down a time event, a low power idle mode is used, where almost nothing operates but the timer. After the alarm has sounded the ear-piece 10 enters a power-off mode, to be awakened by subsequent communications.

Returning to FIG. 5, the base station 19 initially transmits whenever it is ready. The period of active bit transitions defines the base station transmit interval 51. After a minimum transmit idle delay 58 of 40 bits from the last transition, the base station 19 locks out further transmits. This time-out period defines the transmit idle interval 52. The base station 19 is not permitted to transmit again until after the receive interval 53, in the next base station transmit OK interval 54. The actual base station 19 timing is defined by an additional base station transmit delay 59 of 160 bits after the end of the transmit idle interval 52. During the receive interval 53 interval the base station 19 listens for data from the ear-piece 10.

The ear-piece 10 uses this same timing, first listening for transmissions from the base station 19, then waiting for an ear-piece transmit wait delay 56 of 50 bits before sending data. This is slightly longer than the minimum transmit idle delay 58 to avoid collisions on the data line. It must complete its transmission before the base station transmit OK interval 54.

Figure 7A:
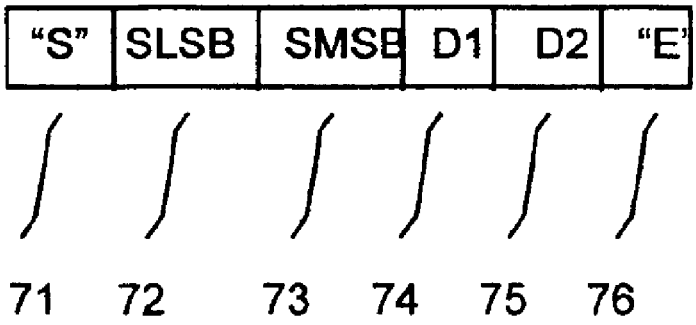
FIG. 7A shows the format of current-time messages from the ear-piece to the base station.

The format of the returned data is given in FIG. 7A. The message starts with a start message flag 71, an ASCII "S", and ends with an end message flag 76, an ASCII "E". A setting least-significant byte 72 and setting most-significant byte 73 echo the most recent setting from the base station 19, with one exception. If the previous alarm time has been reached, the least-significant bit of setting least-significant byte 72 will always be zero.

The ear-piece data byte-1 74 and ear-piece data byte-2 75 are not explicitly used. They were included in the message for diagnostic purposes. They give the timer control register setting and the divide down reset count for the ear-piece processor 35, respectively. The values are described in the Atmel processor documentation.

FIG. 5 shows as much of the protocol as must be understood by the interface processor 34. It copies bits from the personal computer 18 to the ear-piece 10 during the base station transmit interval 51, and copies bits in the other direction during the receive interval 53. In parallel with the ear-piece processor 35, the interface processor 34 decodes bit times from the sync signals in order to determine the appropriate delays. Since it is running off external power, it is never concerned with applying sleep or power down modes to reduce power.

After transmitting data during the ear-piece transmit interval 55, the ear-piece 10 waits for at least an ear-piece setting wait delay 57 of 256 bits before returning to a power down state. This delay must extend beyond the end of the base station transmit delay 59 in the base station 19, to assure that new setting data is received.

Figure 7B:
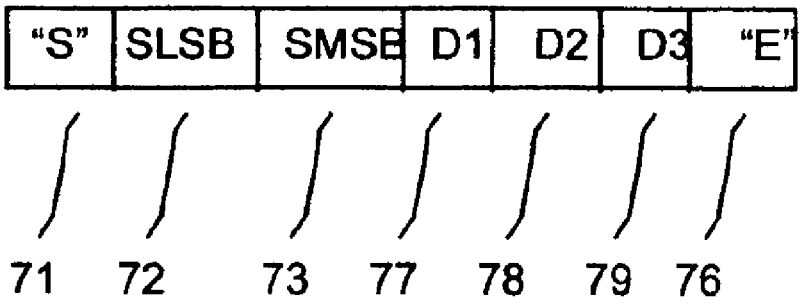
FIG. 7B shows the format of new setting messages from the base station to the ear-piece.

The format for new settings is given in FIG. 7B. The start message flag 71, end message flag 76, setting least-significant byte 72, and setting most-significant byte 73 are the same as in the previous settings message. The setting least-significant byte 72 and setting most-significant byte 73 combine to form a 16-bit setting value. But, only the least significant bit of this value has any meaning to the ear-piece 10. It is a bit flag, 1 indicating that the ear-piece 10 is "on" and 0 indicating that it is "off". As with a typical alarm clock, this allows the time setting to be kept at a regularly-used value even when the alarm is not set. If the alarm is "off" the ear-piece 10 goes to sleep and awaits further input after communications are completed. If the bit is "on" it goes into a count down and alarm sequence.

The other setting bits are used only within the base station 19. The next bit, bit 1, indicates to the base station 19 whether the current setting is an absolute alarm time, 0, or whether it is a countdown delay alarm, 1. In the former case, the remaining bits give the number of minutes from midnight until the alarm time. In the later case these bits give the number of seconds of delay.

The actual timing information to the ear-piece 10 is contained in the next 3 bytes, delay byte-1 77, delay byte-2 78, and delay byte-3 79. These form a 24 bit word contain a delay count in "ticks" where one tick is 1024 millionths of a second. This delay specifies the time from the ear-piece 10 being set until the alarm should sound. Since the ear-piece 10 is always connected to the base station 19 when set, there is no need for the ear-piece 10 to keep an absolute time reference. These bytes have no particular meaning if the alarm is set to "off".

Figure 4:
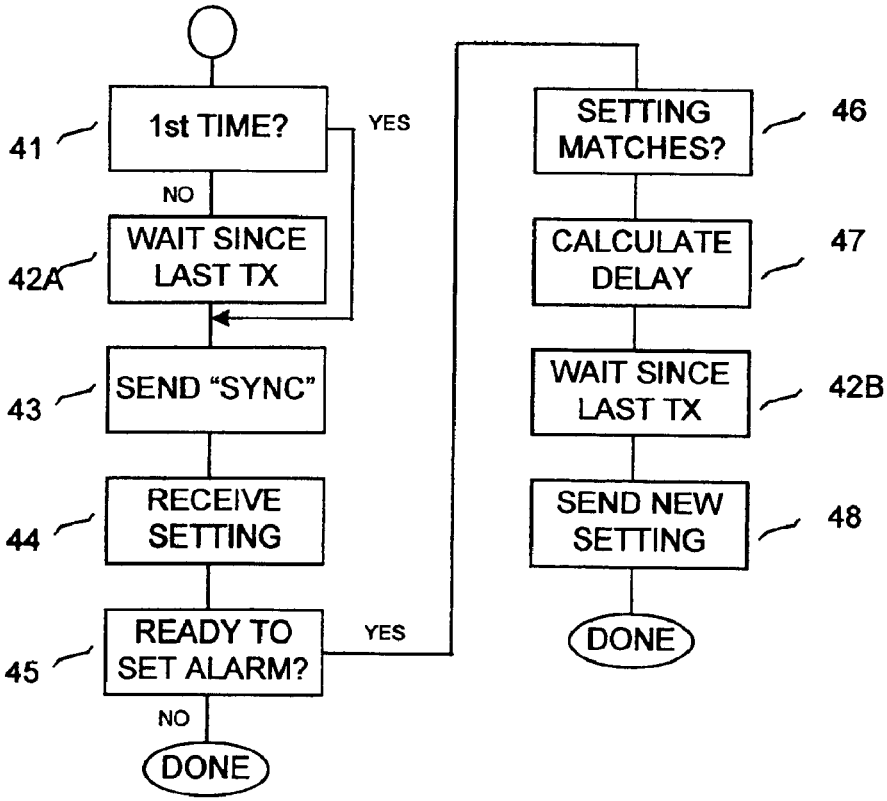
FIG. 4 shows the sequence of events in the personal computer software or base station logic for retrieving the setting from an ear-piece, and for applying new settings.

Base Station Logical Low (FIG. 4)

The base-station logic for this process is given in FIG. 4, as currently implemented in the personal computer 18 base station 19. This sequence is used whenever the user indicates a desire to set the attached ear-piece 10. Additional elements required in the software, such as a current-time display, setting controls, etc., are easily assembled by one skilled in the art, and the details of this implementation have no bearing upon the current invention.

If this is the first time that the base station 19 is communicating to the ear-piece 10 since the software has been initiated, a repeat test 41 bypasses the next step. Otherwise a transmit wait 42A, as above, is applied to delay transmission into the base station transmit OK interval 54. Having assured that the shared line is clear, the base station 19 does a send sync 43, using the sync described above. If the ear-piece 10 has already been awakened by reading its setting, a short, 8 character sync, can be used. It then listens for data from the ear-piece 10 in receive setting 44. When simply reading the previous setting, as determined by setting available test 45, this is the end of the process. When the user has supplied a new setting we first apply a setting available test 46. If not, we return with an error. This verifies that the same ear-piece 10 is still in place. Breaking the process into two pieces in this manner allows the user to examine the current "set" time at leisure before specifying a new setting. Given now that we know this is the right ear piece and have a new setting, we go to the calculate delay 47 step. This converts the difference between the set time and the current time from the base station 19 into a time difference in "ticks" as above. Any possible delay up to 24 hours fits within the 24-bit tick count. Again, we wait until the next transmit window next transmit wait 42B, and do the send new setting 48.

This structure has some additional implications for the base station 19 logic. It can interrupt the current count down in the ear-piece 10 by sending a new sync. This is treated no differently than above. However, since the ear-piece 10 operates on a set delta-time, and this countdown is disrupted by a new setting, the base station 19 must supply a new delay. By default the ear-piece 10 will turn itself off when the current setting is read. The current base station 19 software leaves the alarm turned off if it was set for a time delay. If it was set for a specific alarm time and no new setting is supplied, a default setting corresponding to the same alarm time is sent to the ear-piece 10.

Figure 3:
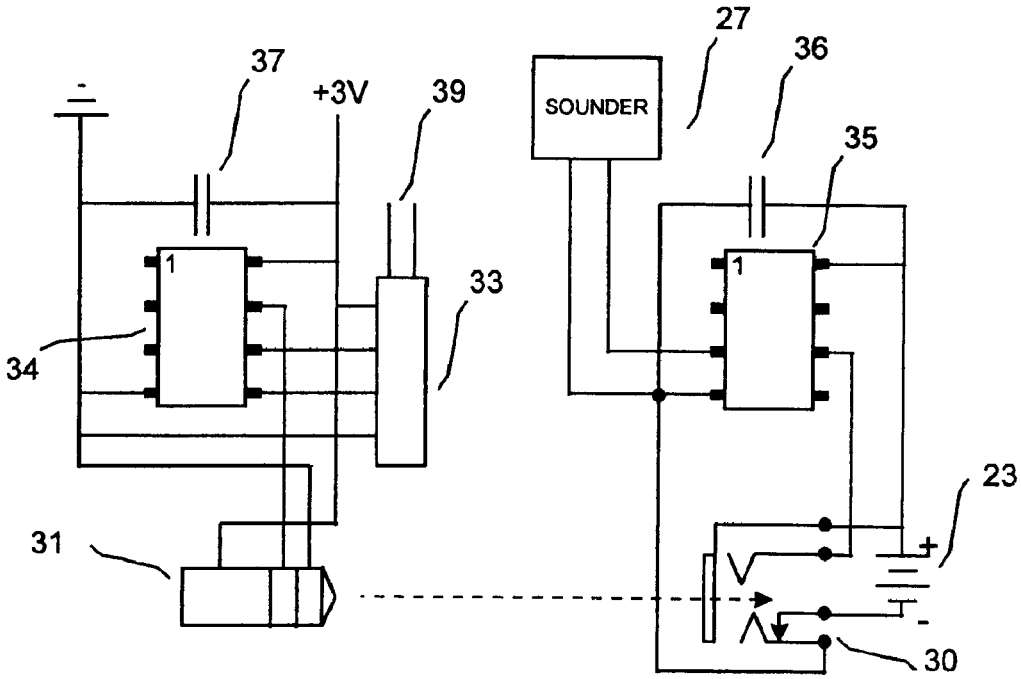
FIG. 3 shows the embodiment of the ear-piece and of the personal computer interface.

Hardware Implementation Details (FIGS. 3, 8A, 8B)

The preferred embodiment given here is tailored for small quantity production, using off-the-shelf parts to minimize the initial investment, albeit with methods not suited to quantity production. Implementing these functions in custom components for quantity production is a simple exercise for one skilled in the arts of miniature electronics and production packaging, given the interface and functional description presented. However, the method of producing a miniature ear-piece 10 from off-the-shelf components is far from obvious, and therefore is detailed here.

FIG. 3 details the preferred embodiment of 1B. The base station connector 17 is implemented as a stereo micro-plug 31. This form is used because it is widely available with receiving sockets, micro-jack 30, which can disconnect ear-piece power whenever the plug is inserted. Ground is placed in the tip to avoid shorting power to the signal line as the plug is inserted. +V is on the plug base so that a full circuit is never completed until the plug is fully inserted. This leaves the signal line on the middle connector. Thus the micro-jack 30 serves the purposes of the ear-piece interface 20, disconnect and power 21, and signal separation 22 in FIG. 2.

The left side of FIG. 3 shows the interface adapter 16 which provides power to the ear-piece 10 and which multiplexes RS-232 serial port transmit and receive data from the personal computer 18 onto the single data line to the ear-piece 10. It implements these function in an Atmel ATTiny12 micro-controller, an interface processor 34, to make use of readily available commercial parts. Code for this processor is given in FIG. 8B. Using the Atmel processor requires converting the RS-232 data lines in/out 39 to/from TTL in an RS-232 level converter 33. This function is easily implemented in a variety of commercial parts. As per normal practice, the RS-232 connector to the personal computer 18 connects DTR to DSR and CTS to RTS, as defined in the RS-232 specification, to allow communication.

Power for the interface adapter 16 would typically come from a separate regulated power supply. In some cases, the power may be drawn from the computer's RS-232 DTR and regulated to the desired levels, but the current implementation sometimes draws more current than some computers will supply. This would not be the case with custom electronic components. An interface isolation capacitor 37 has proven necessary across the power and ground for reliable operation in current configurations. The voltage should be the same as that from the ear-piece battery 23, currently 3v.

The right side of FIG. 3 shows the ear-piece 10. As previously stated, the ear-piece interface 20, disconnect and power 21, and signal separation 22 are all provided by the micro-jack 30. Specifically, the part used in a Stack Electronics SMT 2534. The controller 24, timer 25, and non-volatile storage 26, are provided by an ear-piece processor 35, another Atmel ATTiny12 micro controller. A lower voltage, Atmel "V", version is preferred to allow operation using a single battery, but this chip was not available for the initial prototype. The surface-mount packaging for ear-piece processor 35 is used here. The code for this micro-controller is given in FIG. 8A. Again, an ear-piece isolation capacitor 36 has proven necessary for reliable operation with current parts.

To improve the timing accuracy the ear-piece 10 must be calibrated. The Tiny12 processor provides a timing calibration byte, as described in the Atmel documentation. This is loaded from byte 8 of the program memory. This must be replaced with a value that provides a 1 MHz clock at the desired supply voltage when operating at body temperature. This can be measured before the unit is assembled with standard techniques. Proximity to the ear holds the unit at near body temperature, reducing thermal timing variations. Note that calibration is not necessary for the interface processor 34, since it measures only relative timing.

The sounder 27 is a modified piezo-microphone. These microphones are readily available in standard condenser-microphone packages, about ¼" long and in diameter, with a metal shell, and are constructed as follows: the shell edges are crimped over a small circuit card across the back with solder pads for the signal leads. These microphones rely on the pressure fit of the crimped back, through the circuit card, through a plastic spacer, to an insulating gasket and metal holding disk, and finally to the piezo element and back to the case, in order to maintain an electrical connection. One pole of the piezo element is connected to the case. The other pole is connected, via the metal plate, to the base of a transistor inside the microphone. One transistor lead connects to the case. The case and the remaining transistor lead connect to solder pads on the miniature circuit card at the back of the microphone. These are the device terminals. We take advantage of this structure to form a uniquely compact device, by converting it into a sounder.

Figure 9:
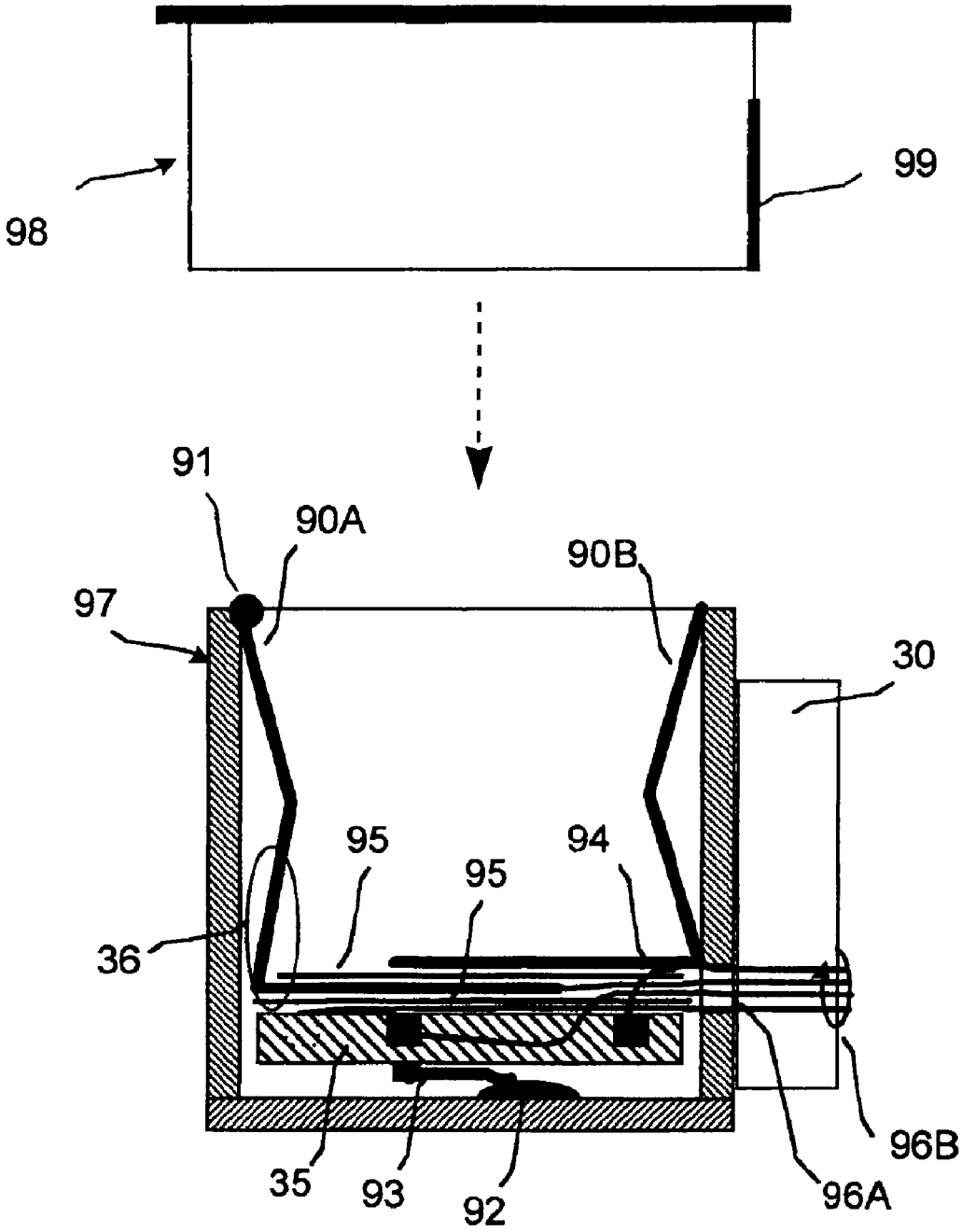
FIG. 9 shows the assembled configuration for the ear-piece.

Assembly (FIG. 9)

The piezo-microphone forms not only the sounder 27, but also the case for the entire ear-piece 10. Most of the other components are assembled inside this shell. This is strictly a concession to building this device in a small form-factor from commercially available parts. For a quantity production design with custom-manufactured parts, the following assembly details would not be germane.

First, we grind out the inside of the piezo microphone, being sure to leave the plastic spacer material under the crimped edges intact, as required to maintain the pressure connection to the piezo element. This can easily be done with a small grinding element on a Dremel tool. The plastic cannot simply be drilled out. A drill of the appropriate diameter puts too much torque of the plastic spacer, causing it to spin and ruining the piezo element. After most of the material has been removed, the transistor is exposed. It remains connected only to the metal plate over the piezo element: the other two connections have been ground off. The transistor is broken free with dental tools. Sometimes the lead remains attached to the metal plate, and can be ground off. This leaves us with the cored-out piezo microphone 97 in FIG. 9. Next, we attach a short wire to the metal plate, the sounder connection 93 using a conductive epoxy bond 92. This produces a sounder sub-assembly.

The ear-piece processor 35 will be inserted inside the cored-out piezo microphone 97, but first everything must be attached to it. A surface-mount package is used, DIPS do not fit in the space available.

After the chip is programmed, the DB4 pin is bent backward until it is flat against the top of the chip. DB pins are defined in the Atmel documentation. The other end of sounder connection 93 is soldered to this pin. Note that the chip will be installed upside down. Of the remaining pins, only power, ground, and DB2 are used. These are bent flat against the sides of the chip in the other direction, and clipped flush with the bottom. Wires are soldered to these pins before proceeding. The remaining pins are clipped off. These wires will be connected as shown in FIG. 3: FIG. 9 does not show every connection.

Next an insulating layer 95A is glued to the bottom of the chip, to prevent pins from shorting against the battery contacts which will be placed next. Power transistor base pads can be cut down and serve well for this purpose. A battery – contact 90A, second insulating layer 95B, and battery + contact 90B are glued in order on top of this as shown. Battery contacts are sized and bent to firmly hold the ear-piece battery 23 between them. In practice, two batteries are used in series. Note that the battery+contact 90B is connected both to the wires to connector 96B and to the contact to chip Vcc 94. The ear-piece isolation capacitor 36 is placed across the chip power and ground using a short insulated wire. All of these components are attached so that they do not extend beyond the footprint of the ear-piece processor 35.

This subassembly is pushed down inside the cored-out piezo microphone 97, with wires to connector 96B routed out through a wire routing hole 96A. After it is in place a connection to case 91 connects the battery – contact 90A to the remnants of the cored-out piezo microphone 97 case-connection solder pad. This provides the return circuit for the piezo sounder. A small non-conductive ribbon is then glued to the edge of the cavity so that the ribbon goes into the cavity, then back up the other side. This is the usual aid to help remove batteries. At this point we have a cored-out piezo microphone 97 with wires to connector 96B extending from it.

The micro-jack 30 is first prepared by folding the surface mount leads back against the under side of the part. The wires to connector 96B are cut as short as practical and soldered to the micro-jack 30, which is then epoxied to the outside of the case, contacts inward. Epoxy is placed over the wires and contacts to protect them, and to insulate contacts from the case. The micro-jack 30 must be placed so that it does not extend to the back of the case, so that socket is nominally horizontal, into or out of the paper, and so that the plug may be inserted while the ear-piece 10 is inside the gel ear-piece adapter 15. Detailed connections to the micro-jack 30 are given in FIG. 4, and are not reproduced here.

Batteries are placed inside the remaining opening, and a plastic cap 98 keeps them free from contamination. The plastic cap 98 must be cut to length, and must have a gap 99 cut in one side to fit over the expoxied micro-jack 30. Note that it may stick somewhat above the base station connector 17, depending upon the batteries selected. Suitable caps are available from Caplugs. The type used to protect cable-TV splitter sockets also works well.

Alternative Embodiments

Nothing in this description should be construed as restricting the implementation to that described. For example, the following are obvious extensions:

(a) The entire assembly could be replaced with custom components, eliminating the current assembly procedure.

(b) The specific micro-controllers can be replaced with other chips.

(c) The micro-jack 30 and stereo micro-plug 31 could be replaced with other type of connectors, particularly favoring those without open orifices. Inductive coupling is a particularly desirable option.

(d) The RS-232 connection to the interface adapter 16 can be replaced with other standard personal computer 18 interfaces, such as USB. The protocol would, of course, have to be modified appropriately.

(e) The need for the gel ear-piece adapter 15 can be eliminated by using an appropriately shaped case with soft elements. To support a variety of users, adapting components would still be required.

(f) The disposable ear-piece battery 23 could be replaced with a rechargeable battery and charging mechanism.

(g) Volume control and sound selection mechanism can easily be added. The methods are simple to one versed in the art.

(h) The ear-piece 10 could process an absolute alarm time, rather than a time delay after it is set. This might be simpler if more extensive clock functions are added to the ear piece (sharp time, etc.), but would require a method to set and verify the internal clock.

Conclusions, Ramifications, and Scope

By separating the alarm clock into a base station and autonomous ear-piece we obtain a wide variety of advantages.

(a) The ear piece becomes far smaller and more usable, particularly by virtue of eliminating displays and controls. This is such an overwhelming benefit that it makes it possible to construct a usable-sized ear-piece from off-the-shelf components. Even with productization and custom parts for quantity production, this is a substantial benefit.

(b) This approach eliminates dangerous wires, and removes any dependency upon the base station after the ear-piece is disconnected from it.

(c) The base station becomes able to support an unlimited number of ear-pieces, without any added complexity. Each ear-piece remembers its own settings, so that it may be simply turned "on" again for the next night.

(d) The ear-piece can simply count down from the time at which it is set, thus it has no need to maintain absolute accuracy over an extended time. A simple timing mechanism is sufficient.

What is claimed is:

1. An ear-plug alarm system including by this reference any generalized time triggering system comprising:

(A) a base-station or setting device further comprising:
- (a) a master time reference,
- (b) user controls for designating alarm events or setting alarm times, possibly including a display and buttons or connection to other remote input means, (B) one or more ear-pieces, comprising:
- (a) a local time reference separate from said base-station master time reference,
- (b) storage means for holding settings from the base-station
- (c) a controller for determining when said alarm time is reached based upon said local time reference and the stored setting,
- (d) a power source, possibly rechargeable from the base-station whereby the logic is powered for autonomous operation after disconnection from the base-station and
- (e) one or more interfaces to initiate responses at said alarm event, whereby the ear-piece is entirely autonomous once set and operates without further support from or connection to said base-station, (C) means of directly connecting any one of said ear-pieces to said base-station such that:
- (a) the presence of this connection implicitly selects the particular ear-piece to be set among multiple ear-pieces in near proximity, whereby a single setting device can unambiguously control multiple ear-pieces, setting them one at a time, without separate addressing or selections,
- (b) the connection provides a means of transferring settings from said base-station to said ear-piece, where a single base-station may include a plurality of such connections.

2. The ear-plug alarm system of claim 1 wherein the means of connecting the base-station to the ear-piece selects the ear-piece via these two pieces being substantively in physical contact, including without limitation when said means comprises an electro-magnetic coupling.

3. The ear-plug alarm system of claim 1 wherein the means of connecting the base-station to the ear-piece comprises a direct physical connection, including without limitation an electrical connector.

4. The ear-plug alarm system with direct physical connection of claim 3 when configured as an alarm clock wherein means are provided for the resulting time trigger to initiate an alarm to the user, including but not limited to audio alarm signals.

5. The two-piece alarm clock of claim 4 wherein said ear-piece sits near the users ear when in use after being set, and includes means to generate a tactile or audio alarm at the specified time.

6. The near-ear ear-plug alarm of claim 5 where said ear-piece sits substantially within the user's car.

7. The ear-plug alarm of claim 1 wherein:

(A) the ear-piece includes memory to retain settings alter the alarm event has occurred, (B) the connecting means includes means of communicating said settings from the ear-piece to the base station before setting the next alarm event, (C) the base-station controller includes means of presenting said settings to the user as an initial default for the new alarm setting, whereby each ear-piece acts like a separate alarm clock with it's user's preferred wake-up time being retained from one day to the next, even when multiple users share the same base-station.

8. The ear-plug alarm with setting memory of claim 7 wherein:

(A) the device is configured specifically as an ear-plug alarm, (B) the means of connecting the base-station to the ear-piece comprises a contact or inductive electrical connection, (C) the ear-piece sits near or substantially within the users ear when in use after setting, (D) the ear-piece includes mans of producing an audible or tactile alarm at the specified event time.

9. The ear-plug alarm system of claim 1 wherein:

(A) said local time reference in said ear-piece may be implicitly reset from said base station master time reference, (B) the alarm event is designated relative to this reset reference, including without limitation where the alarm event is designated as a delay from a time mark established via said connecting means during setting, whereby drift in the local time reference does not accumulate between settings, thus enabling the use of less expensive timing references such as the local oscillator in a commercial micro-processor.

10. The ear-plug alarm with implicit time reset of claim 9 wherein the information communicated from the ear-piece to the base station includes a predetermined local time reference drift-calibration which is used to pre-compensate alarm event settings, whereby ear-piece time references with even less absolute accuracy may provide the same alarm event accuracy.

11. The ear-plug alarm system of claim 10 wherein:

(A) the device is configured specifically as an ear-plug alarm, (B) the means of connecting the base-station to the ear-piece comprises a contact or inductive electrical connection, (C) the ear-piece sits near or substantially within the users ear after setting during operation.

(D) the ear-piece includes mans of producing an audible or tactile alarm at the specified event time.

* * * * *